US005365889A

United States Patent [19]

Tang

[11] Patent Number: 5,365,889

[45] Date of Patent: Nov. 22, 1994

[54] FLUIDIZED BED REACTOR AND SYSTEM AND METHOD UTILIZING SAME

[75] Inventor: John T. Tang, Easton, Pa.

[73] Assignee: Fostyer Wheeler Energy Corporation, Clinton, N.J.

[21] Appl. No.: 976,024

[22] Filed: Nov. 13, 1992

[51] Int. Cl.[5] ..... F23D 19/00; F23G 5/00

[52] U.S. Cl. ..... 122/4 D; 110/245; 165/104.16; 422/146

[58] Field of Search ..... 110/245, 234; 122/4 D; 422/141, 146; 165/104.16

[56] References Cited

U.S. PATENT DOCUMENTS

| | | | |
|---|---|---|---|
| 3,893,426 | 7/1975 | Bryers | 122/4 D |
| 3,976,747 | 8/1976 | Shale et al. | 423/244 |
| 4,249,472 | 2/1981 | Mitchell | 110/245 |
| 4,259,088 | 3/1981 | Moss | 48/212 |
| 4,270,468 | 6/1981 | Robinson et al. | 110/245 |
| 4,436,507 | 3/1984 | Stewart et al. | 431/170 |
| 4,457,289 | 7/1984 | Korenberg | 122/4 D |
| 4,469,050 | 9/1984 | Korenberg | 122/4 D |
| 4,548,138 | 10/1985 | Korenberg | 110/245 |
| 4,646,661 | 3/1987 | Roos et al. | 110/245 |
| 4,688,521 | 8/1987 | Korenberg | 122/4 D |
| 4,753,180 | 6/1988 | Narisoko et al. | 110/346 |
| 4,809,623 | 3/1989 | Garcia-Mallol | 110/347 |
| 4,809,625 | 3/1989 | Garcia-Mallol et al. | 110/347 |
| 4,828,486 | 5/1989 | Sakamoto et al. | 431/170 |
| 4,856,460 | 8/1989 | Wied et al. | 122/4 D |
| 4,860,694 | 8/1989 | Walker | 122/4 D |
| 4,936,230 | 6/1990 | Feugier et al. | 110/234 |
| 5,108,712 | 4/1992 | Alliston et al. | 422/141 |
| 5,218,932 | 6/1993 | Abdulally | 122/4 D |

FOREIGN PATENT DOCUMENTS

| | | |
|---|---|---|
| 2203964 | 5/1974 | France . |
| 2618291 | 4/1976 | Germany . |
| 63-38813 | 2/1988 | Japan . |

*Primary Examiner*—John M. Sollecito
*Assistant Examiner*—William C. Doerrler
*Attorney, Agent, or Firm*—Marvin A. Naigur

[57] ABSTRACT

A fluidized bed reactor and system and method utilizing same for the combustion of waste fuels in which the reactor vessel is divided into three vessels. Waste fuel is introduced into the fluidized bed within one vessel where it is mixed with bed make-up material that is controlled to provide an ideal environment for the generation of pyrolytic gases. The fluidized bed material is pneumatically and gravitationally conveyed downwardly, and injected into a fluidized bed within the second vessel where the involatile organic material undergoes combustion in an oxidizing atmosphere. The bed material in the second vessel is pneumatically conveyed upwardly and divided into two portions, one of which is recycled back to the first vessel. The other portion of the bed material in the second vessel is circulated to a fluidized bed within the third vessel where heat is recovered. The bed material in the heat recovery vessel is gravitationally conveyed back to the second vessel to regulate the temperature in the latter vessel.

16 Claims, 1 Drawing Sheet

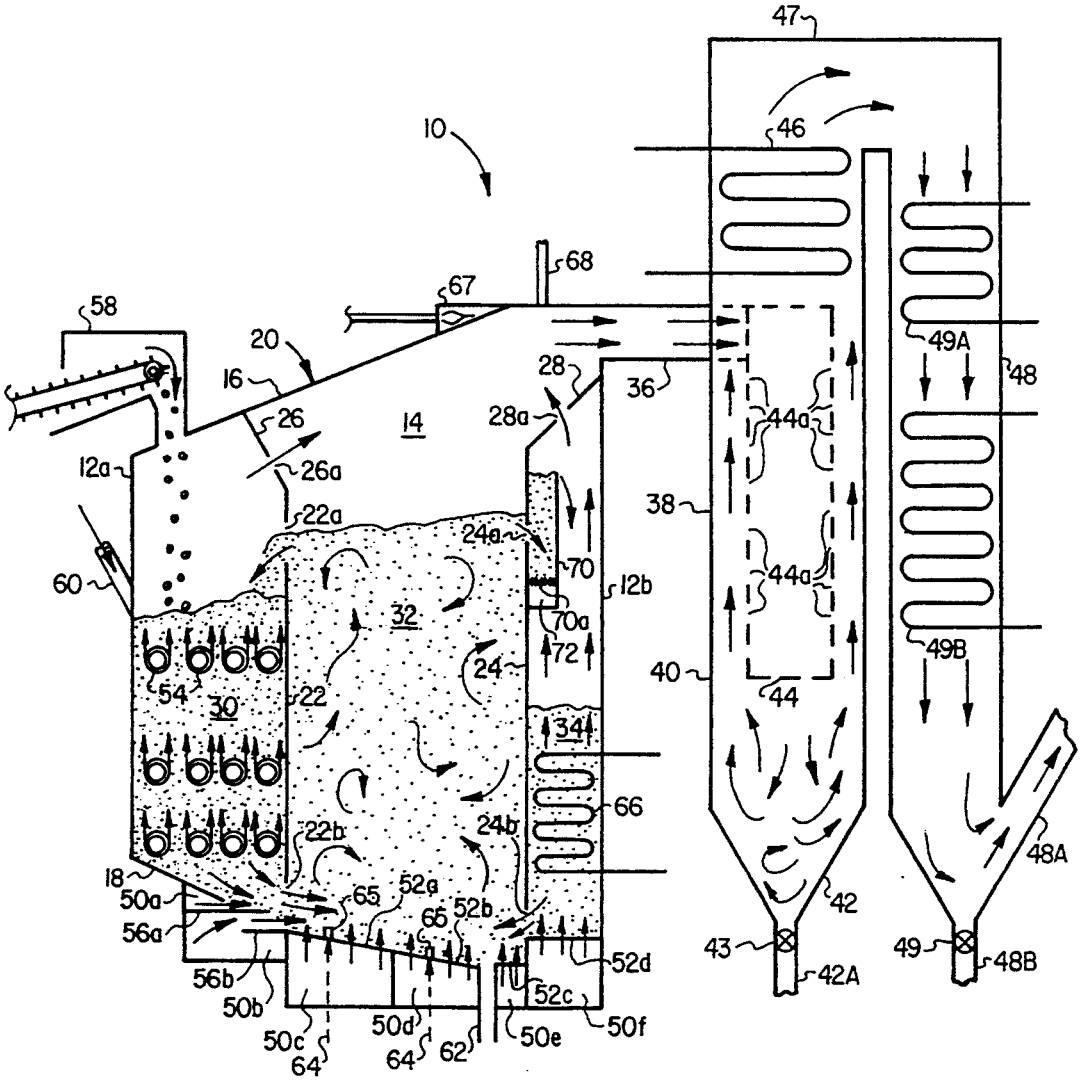
10
14
16
18
20
22
22a
22b
24
24a
24b
26
26a
28
28a
30
32
34
36
38
40
42
42A
43
44
44a
46
47
48
48A
48B
49
49A
49B
50a
50b
50c
50d
50e
50f
52a
52b
52c
52d
54
56a
56b
58
60
62
64
65
66
67
68
70
70a
72
12a
12b

FLUIDIZED BED REACTOR AND SYSTEM AND METHOD UTILIZING SAME

FIELD OF THE INVENTION

This invention relates to an improved fluidized bed reactor and method, and more particularly, to a fluidized bed reactor and method for incinerating combustible materials such as municipal and industrial wastes.

BACKGROUND OF THE INVENTION

The use of a fluidized bed reactor for the incineration of refuse, such as municipal and industrial wastes, in the form of sludge is generally known and involves the burning of sludge with air while fluidizing it in a fluidized bed. In order to improve the combustion along with the fluidizing of the sludge, a bed make-up material such as sand or clay with limestone are fed together with the sludge to the fluidized bed.

A typical type of fluidized bed reactor is equipped with a plurality of air diffuser tubes or plates in the lower section of the reactor body, and the upper section of the reactor body is equipped with a sludge feeding unit and a bed make-up material feeding unit. The sludge is burned while both the sludge and the bed make-up material are fluidized by primary air which is blown out through the air diffusers.

As the organic compounds are decomposed and burned within the fluidizing bed, the incombustibles descend along with the fluidizing medium down through the reactor and pass through the gaps between the air diffuser tubes in the lower section of the fluidizing bed. The fluidizing medium is separated from the combustion residue, and is returned to the fluidized bed.

The sludge is generally of low calorie content and contains high concentrations of volatile organic compounds, salt, and moisture. As the sludge is fed to the fluidizing bed, the volatile organic compounds are decomposed to generate pyrolytic gases, and the incombustible substances and ash are left in the form of particulate material. In addition, sludge has substantial adhesive properties and since the sludge is deposited directly on the fluidized bed, it is quickly dried, decomposed and ignited which can lead to the formation of ash agglomerations resulting in frequency reactor shutdown.

Further, as the concentration of volatile organic compounds can vary substantially from batch to batch, and even within a single batch of sludge, it is difficult to maintain stable combustion which results in unacceptable emissions of hazardous and toxic gases. Further, the unregulated burning of sludge can result in the formation of highly corrosive gases, such as HCl, HBr etc., as well as, the creation of low oxidation states of metals which are environmentally hazardous. As a result, the typical fluidized bed reactor of this type is incapable of meeting all of the Environmental Protection Agency's (EPA's) stringent emission requirements for compounds, such as SOx, NOx, CO, VOC, and dioxin, as well as EPA specifications for gas temperature and gas retention time required for the destruction of toxic gases.

SUMMARY OF THE INVENTION

It is therefore an object of the present invention to provide a system and method of operating a fluidized bed reactor for providing clean and efficient combustion of waste fuels, such as sludge.

It is still a further object of the present invention to provide a system and method of the above type for providing stable combustion of waste fuels while reducing the emission of hazardous ash and hazardous gases.

It is still a further object of the present invention to provide a system and method of the above type which meets the EPA's specifications for the destruction of toxic gases.

It is still a further object of the present invention to provide a system and method of the above type in which waste fuels are combusted while producing relatively few corrosive gases.

Toward the fulfillment of these and other objects, the system and method of the present invention features a bubbling fluidized bed reactor including a pyrolysis vessel, a combustion vessel, a heat recovery vessel, a gas mixing vessel and a boiler bank. Sludge material is introduced into the fluidized bed within a pyrolysis vessel where it is mixed with bed make-up material that is controlled to provide an ideal environment for the generation of a plurality of pyrolytic gases. The fluidized bed material in the pyrolysis vessel is pneumatically and gravitationally conveyed downward, and injected into an adjacent fluidized bed within a combustion vessel where the involatile organic material undergoes combustion in an oxidizing atmosphere. The bed material in the combustion vessel is pneumatically conveyed upward and divided into two portions, one of which is recycled back to the pyrolysis vessel. The other portion of the bed material is circulated to an adjacent fluidized bed within a heat recovery vessel where heat is recovered. The bed material in the heat recovery vessel is gravitationally conveyed back to the combustion vessel which helps to regulate the temperature in the combustion vessel. The gases thus generated are injected into a vortex vessel which aids in the destruction of toxic gases, and subsequently, heat is extracted from the gases by a series of heat exchangers within a boiler bank.

BRIEF DESCRIPTION OF THE DRAWINGS

The above brief description as well as further objects, features and advantages of the method of the present invention will be more fully appreciated by reference to the following detailed description of presently preferred but nonetheless illustrative embodiments in accordance with the present invention when taken in conjunction with the accompanying drawing which is a schematic view depicting the fluidized bed reactor of the present invention.

DESCRIPTION OF THE PREFERRED EMBODIMENT

With reference to the attached drawing, the numeral 10 designates a fluidized bed reactor of the present invention which includes a front wall 12*a*, a spaced, parallel rear wall 12*b*, two spaced side walls, one of which is shown by the reference numeral 14, which extend perpendicular to the front and rear walls, a roof 16 which slopes upward from the front wall to the rear wall, and a floor 18 which slopes downward from the front wall to the rear wall to form a substantially enclosed reactor housing 20. The housing 20 is divided into three vessels by two spaced, parallel partition walls 22 and 24 which are also spaced and parallel to the front and rear walls 12*a* and 12*b* and are perpendicular to, and extend between, the side walls 14. The partition wall 22 is connected to the roof 16 by a downwardly sloping wall 26 and the partition wall 24 is connected to the rear wall 12*b* by an upwardly sloping wall 28. As a result, a pyrolysis vessel 30 is defined between the front wall 12*a* and the partition wall 22, a combustion vessel 32 is defined between the two partition walls 22 and 24, and a heat recovery vessel 34 is defined between the partition wall 24 and the rear wall 12*b*.

A duct 36 connects the housing 20 to a gas mixing section 38 defined by a cylindrical housing 40 with a conical base 42 having an outlet 42A in which a rotary valve 43 is located. Disposed within, and concentric to, the housing 40 is a cylindrical, vortex vessel 44. The duct 36 extends through openings (not shown) formed in the side of the housing 40 and the vortex vessel 44. A plurality of smaller openings 44*a* are formed in the walls and the top and bottom of the vortex vessel 44 for purposes that will be described later. A heat exchanger 46 of conventional construction is disposed in the upper portion of the housing 40.

A duct 47 connects the upper end of the mixing section 38 to the upper end of a boiler bank 48 containing two heat exchangers 49A and 49B also of conventional construction. Two outlets 48A and 48B are provided in the lower portion of the boiler bank 48 and a rotary valve 49 is disposed in the outlet 48B.

A plurality of plenum chambers 50*a*–50*f* are disposed below the reactor housing 20, with the chambers 50*a* and 50*b* extending below the vessel 30 and with the chamber 50*a* being disposed above the chamber 50*b*. The chambers 50*c*, 50*d*, and 50*e* are disposed below vessel 32, and adjacent to one another and the chamber 50*f* is disposed below the vessel 34. Pressurized air is introduced into the chambers 50*a*–50*f* from a suitable source (not shown) by conventional means, such as a forced-draft blower. The air may be preheated by burners and appropriately regulated by air control dampers as needed with the air supply to chamber 50*c* independently regulated for purposes that will be described later.

A plurality of perforated air distribution plates 52*a*–52*d* are suitably supported at the lower portion of the reactor housing 20, and form the upper wall, or roof, of the plenum chambers 50*c*–50*f* respectively. The plates 52*a* and 52*b* slope downwardly toward the back of the combustion vessel 32 for purposes that will be described later. The air introduced through the plenum chambers 50*c*–50*f* thus passes in a upwardly direction through the plates 52*a*–52*d*.

A plurality of air diffuser tubes, or spargets, 54 are suitably supported within the pyrolysis chamber 30 and extend through the side wall 14. The spargers 54 are connected to a conventional fluidizing air source and are independently regulated for purposes that will be described later.

Two horizontal, parallel plates 56*a* and 56*b* are suitably supported at the lower portion of the pyrolysis vessel 30, with the plate 56*b* forming an extension of the plate 52*a* and defining the chambers 56*a* and 56*b*. Thus the air introduced through the plenum chamber 50*a* passes in a horizontal direction between the floor 18 and the plate 56*a*, while the air introduced through the plenum chamber 50*b* passes in a horizontal direction between the two plates 56*a* and 56*b* for purposes that will be discussed later. A fluidized bed of a bed make-up material is disposed in the vessel 30 and is supported by the floor 18 and the plates 56*a* and 56*b*. The bed make-up material consists of sludge, fly ash and crushed limestone, or dolomite for absorbing the sulfur formed during the combustion of the sludge.

Two openings 22*a* and 22*b* are formed through the upper and lower portions, respectively, of the wall 22 to communicate the vessels 30 and 32. Similarly, two openings 24*a* and 24*b* are formed through the upper and lower portions, respectively, of the wall 24 to communicate the vessels 32 and 34. Further, two openings 26*a* and 28*a* are formed in walls 26 and 28, respectively, to communicate the upper portions of the vessels 30 and 34 with the combustion vessel 32.

A sludge feeder 58 extends through the roof 16 for introducing sludge onto the fluidized bed within the pyrolysis vessel 30. It is to be appreciated that multiple feeders may be employed for distributing sludge onto the fluidized bed. A pipe 60 is provided for distributing bed make-up material, such as sand or clay together with limestone to the pyrolysis vessel 30 as needed.

A drain pipe 62 registers with an opening between the air distribution plates 52*b* and 52*c*, and extends between the plenums 50*d* and 50*e* for discharging spent fuel and spent bed make-up material from the combustion vessel 32 to external equipment, such as a screw cooler or the like, not shown.

A multiplicity of auxiliary fuel inlets 64 extend through the plenum chambers 50*c* and 50*d*, and the air distribution plates 52*a* and 52*b* and register with a multiplicity of nozzles 65 supported on the plate 52*a* and 52*b* for introducing auxiliary fuels, such as natural gas or oil, into the combustion vessel 32.

A heat exchanger 66 is disposed in the heat recovery vessel 34 and consists of a plurality of tubes connected to flow circuitry for passing steam through the tubes in a conventional manner to remove heat from bed make-up material.

An auxiliary burner 67 registers with an opening (not shown) in the top of the duct 36, and provides auxiliary heating to the duct 36. The burner 67 is provided to maintain the flue gas temperature in the event the gas temperature drops below a required value for efficient pollutant destruction. In addition, an injection pipe 68 is provided which registers with the duct 36 for the injection of NOx reducing agents.

A fluidizing bed housing 70 is disposed in the vessel 34 adjacent the partition wall 24 and registers with the opening 24*a* in the wall 24. A perforated air distribution plate 70*a* is suitably supported in the lower portion of the housing 70 and defines a plenum chamber 72. Pressurized air from a suitable source, as previously described, is introduced into the plenum chamber 72 and appropriately regulated so as to control the fluidization of the bed material in the housing 70. This permits the flow rate of the fluidized bed material to the heat recovery vessel 34 to be controlled as will be described.

In operation of the fluidized bed reactor 10, waste fuel material, such as sludge, is introduced into the pyrolysis vessel 30 by the feeder 58, and the bed make-up material is introduced, via the pipe 60 into the vessel 30. The spargets 54 and the plenum chambers 50*a*, 50*b* are supplied with fluidizing gas that is composed of a mixture of air and flue gas from an external source. The waste fuel and sludge descend through the pyrolysis vessel 30 and are pneumatically transported into the combustion vessel 32 through the opening 22*b* by the horizontally supplied air from the plenum chambers 50*a* and 50*b*. Air is supplied to the plenum chambers 50*c* and 50*d* at a temperature sufficient to commence the burning of the waste fuel material in the combustion vessel 32. Further, auxiliary fuel, in the form of natural gas or oil, may be provided to the burners 65 in the event that the sludge has low calorie content or that bed temperature drops below the required temperature for good carbon burnout. Once the sludge inside the combustion vessel 32 starts burning with the fluidizing air, ignition by the preheated air and/or auxiliary fuel is reduced or ceased as needed.

The quantity of fluidizing gas coming out of the spargets 54 is relatively low with a superficial gas velocity of below three feet per second so that the sludge thus introduced to the pyrolysis vessel 30 undergoes pyrolysis in a reducing atmosphere to create a plurality of pyrolytic gases and involatile organic material. The ratio of air and flue gas is controlled to provide good conditions for the pyrolysis of the sludge and helps to control the bed temperature in the pyrolysis vessel 30. In addition, the gas flow from the spargets 54 adjacent to the front wall 12*a* is reduced relative to the gas flow to the spargers adjacent to the wall 22. Thus, the fluidized bed within the pyrolysis vessel 30 is divided into a high density area adjacent the wall 12*a* and a low density area adjacent the wall 22 which promotes the flow of large quantities of bed material from the back to the front of the pyrolysis vessel 30 which minimizes slagging and the formation of agglomerations within the incinerator 10. Further, this operation enhances sludge pyrolysis and the capture of sulfur and chlorine compounds by the limestone. This removal of sulfur and chlorine compounds not only reduces the gaseous corrosion of components but also decreases the formation of dioxin in the incinerator backpass.

The involatile organic material from the sludge and the bed make-up material are pneumatically and gravitationally conveyed downwardly within the pyrolysis vessel 30 while the pyrolytic gases and the fluidizing air move upwardly and into the combustion vessel 32 through the opening 26*a*. The involatile organic material and the bed make-up material compose the bed material which is pneumatically transported into the combustion vessel 32 through the opening 22*b* by the horizontally supplied air from the plenum chambers 50*a* and 50*b*. This flow of bed material from the pyrolysis vessel 30 to the combustion vessel 32 is thus controlled by the amount of gas flow to the plenum chambers 50*a* and 50*b*. Further, the plates 56*a* and 56*b* are designed to facilitate the flow of a large amounts of both fine and coarse bed material to the vessel 32 while minimizing plate erosion and bed material backsift to the plenum chambers 50*a* and 50*b*.

The bed material in the combustion vessel 32 undergoes combustion in an oxidizing atmosphere which helps to completely oxidize trace metals (e.g., CaS becomes CaSO4), and thus, makes the ash far less toxic for disposal. The plenum chambers 50*c* and 50*d* are operated separately, such that the plenum 50*c* is operated under reduced pressure relative to the plenum 50*d*. The combination of operating the combustion vessel 32 with two different fluidizing air velocity zones in combination with the sloping of the plates 52*a* and 52*b*, aids to disperse bed material coming out of the pyrolysis vessel 30 rapidly and aids to move waste material in the vessel 32 to the drain pipe 62 efficiently. The air supplied to the vessel 32 through the plenums 50*c*, 50*d*, and 50*e* is preheated to a temperature of between 200 and 1400 degrees Fahrenheit and is supplied at approximately 1 to 4 feet per second, depending upon the amount of involatile organic material, and results in the bed material undergoing combustion while being pneumatically transported upwardly by a mixture of air, flue, and combustion gases. The hot, completely combusted bed material, thus transported, will overflow from the upper portion of the vessel 32 back into the pyrolysis vessel 30 and into the housing 70 in the heat recovery vessel 34 through the openings 22*a* and 22*b*, respectively.

By adjusting the amount of fluidizing air to the plenum chamber 72, the flow rate of the bed material from the vessel 32, through the housing 70 and into the heat recovery vessel 34 can be controlled, which, in turn, enables the flow of material back to the pyrolysis vessel 30 to be controlled.

Thus, a portion of the bed material in the combustion vessel 32 is recycled back to the pyrolysis vessel 30 and provides a heat source for the dehydration and pyrolysis of the sludge while the remaining portion is circulated to the heat recovery vessel 34 where heat is recovered by the heat exchanger 66 in a conventional manner. After the energy is extracted from the bed material in the heat recovery vessel 34, the bed material is returned to the combustion vessel 32 through the opening 24*b* in the lower wall portion of wall 24 and aids in regulating the temperature in the combustion vessel 32.

The pyrolytic gases and the fluidizing air move upwardly through the pyrolysis vessel 30 and into the combustion vessel 32 through the opening 26*a*. Similarly, the fluidizing air from the plenum chamber 50*f* moves upwardly through the heat recovery vessel 34 and into the combustion vessel 32 through the opening 28*a*. Thus, the pyrolytic gases from the pyrolysis vessel 30 and the fluidizing air from the heat recovery vessel 34 mix with the fluidizing air, flue gases and the combustion gases from the combustion vessel 32 in the upper portion of the housing 20 prior to introduction into the duct 36. These gases enter the duct 36 where they are mixed with NOx reducing agents introduced by the pipe 68 prior to tangentially entering the vortex vessel 44. The gases diffuse into the housing 40 through the openings 44*a* in the walls while swirling downwardly through the vortex vessel 44 which results in strong mixing of the gases. The mixing of the gases enhances the destruction of organic substances, such as carbon monoxide and dioxin. Further, the burner 67 in the duct 36 is provided to maintain the required temperature for efficient destruction of pollutants. In addition, the gas mixing chamber 38 is designed to retain the gases for the required time at the required temperature to ensure the destruction of toxic gaseous substances and meet EPA specifications. The rotary valve 43 operates to selectively remove any solid particulate material entrained in the gases from the reactor housing 20.

The gases from the housing 40 pass upwardly through an annular passage extending between the vortex vessel 44 and the inner wall of the chamber 38 and pass over the heat exchanger 46 before exiting the chamber 38 via the duct 46. The gases then enter the upper portion of the boiler bank 48 and pass downwardly over the heat exchangers 49A and 49B before exiting the boiler bank via the outlet 48A. The rotary valve 49 in the outlet 48B functions to remove of any condensate or solid particulate material entrained in the gases from the gas mixing section 38.

The reactor and method of the present invention results in several advantages. For example, the use of multiple vessels provides substantial control over the temperature and the oxidizing or reducing atmosphere within the vessels, resulting in considerable control over the various processes within these vessels. Thus, by providing an ideal environment for the pyrolysis of the sludge, corrosive gaseous species are efficiently removed which prevents the formation of hazardous dioxin, and which has the synergistic effect of improving the overall combustion stability within the incinerator. Further, the reducing environment within the pyrolysis vessel inhibits the spontaneous combustion of waste material which often results in the formation of agglomerations within the reactor. In addition, an oxidizing atmosphere within the combustion vessel results in the efficient burnout of involatile organic material and the elimination of hazardous low oxidization states of metallic oxides. Further, the heat recovery vessel not only provides improved control of the flow of bed make-up material from the combustion vessel and control of the temperature within the combustion vessel, but also increases overall system efficiency through the extraction of surplus thermal energy. The innovative gas mixing vessel enhances the elimination of hazardous gaseous species through the effective mixing of the gases and by retaining the gases for the required time at the required temperature for efficient destruction.

It is understood that several variations may be made in the foregoing without departing from the scope of the invention. For example, the present invention is not limited to treatment of a waste fuel material, but has equal application to any combustible material. Also, if the spent bed make-up material contains little recoverable thermal energy, the heat recovery vessel may be eliminated, thus, simplifying the design and construction of the reactor. Further, the reactor housing need not be rectangular, but can be cylindrical in shape with the combustion vessel co-axially disposed in the pyrolysis vessel. In addition, the vortex vessel can be disposed above the combustion vessel, thus simplifying the return of any particulate material entrained in the gases leaving the reactor housing. Further, a screw cooler may be provided for the extraction of thermal energy from the spent bed make-up material for cases when the ash content is low or when the make-up material consists of fine particles. If the spent bed make-up materials are high in ash or salt content, then other means may be provided for the extraction of thermal energy, such as an ash cooler. Also, this reactor may be modified for the incineration of not only sludge, but also slurry and/or refuse and other waste materials.

Other variations, modifications, changes and substitutions are intended in the foregoing disclosure and in some instances some features of the invention will be employed without a corresponding use of other features. Accordingly, it is appropriate that the appended claims be construed broadly and in a manner consistent with the scope of the invention.

What is claimed is:

1. A method of combustion comprising the steps of:

introducing a combustible material into a first enclosure;

introducing air into said first enclosure at different areas thereof, at a plurality of vertically spaced levels within said material and at sufficient velocity to fluidize said material and promote the combustion of said material;

passing said material from said first enclosure to a second enclosure;

introducing air into said material in said second enclosure for fluidizing and combusting said material;

passing a portion of said material from said second enclosure back to said first enclosure; and passing another portion of said material from said second enclosure to external equipment for further treatment.

2. The method of claim 1 further comprising the step of discharging the combustion gases from said first enclosure.

3. The method of claim 1 further comprising the step of discharging air in said first enclosure towards said second enclosure to assist said passage of said material from said first enclosure to said second enclosure.

4. The method of claim 1 wherein air is introduced at different velocities and at different levels in said first enclosure to promote the flow of said material across said first enclosure.

5. The method of claim 1 wherein said air is introduced into said second enclosure at different velocities to direct said material towards an area of said second enclosure, and further comprising the step of draining said material from said area of said second enclosure.

6. The method of claim 1 further comprising the step of passing said treated other portion of said material from said external equipment back to said second enclosure.

7. The method of claim 1 further comprising the step of introducing an auxiliary fuel into said second enclosure for promoting said combustion.

8. A fluidized bed system comprising:

a housing having at least four vertical walls;

a partition horizontally spaced and parallel to at least two of said walls dividing said housing into a first and second enclosure;

means for introducing a combustible material into said first enclosure;

a plurality of vertically spaced pipes extending through at least one of said walls of said first enclosure and immersed in said material to fluidize said material, and promote the combustion of said material and the flow of said material across said enclosure;

means for passing said material from said first enclosure to said second enclosure;

means for introducing air into said material in said second enclosure for fluidizing and combusting said material;

means for passing a portion of said material from said second enclosure back to said first enclosure; and means for passing another portion of said material from said second enclosure to external equipment for further treatment.

9. The system of claim 8 wherein said fluidizing air is introduced into said pipes at different velocities to promote combustion and the flow of said material from said first chamber to said second chamber.

10. The system of claim 8 further comprising an opening extending through said first enclosure for discharging the gases from said combustion.

11. The system of claim 8 further comprising means for introducing air into said first enclosure and towards said second enclosure to assist said passage of said material from said first enclosure to said second enclosure.

12. The system of claim 8 further comprising plate means disposed in said second enclosure for receiving said material, said air introduced into said second enclosure passing through said plate means.

13. The system of claim 8 further comprising means for passing said treated other portion of said material from said external equipment back to said second enclosure.

14. The system of claim 8 further comprising means for introducing an auxiliary fuel into said second enclosure for promoting said combustion.

15. The system of claim 8 wherein said means for passing said material from said first enclosure to said second enclosure and from said second enclosure back to said first enclosure comprises openings extending through said partition.

16. The system of claim 12 further comprising drain means extending in said second enclosure to drain said material from said second enclosure and wherein said means for introducing said air into said second enclosure introduces said air at different velocities across said plate means to direct said material towards said drain.

* * * * *

UNITED STATES PATENT AND TRADEMARK OFFICE

CERTIFICATE OF CORRECTION

PATENT NO. : 5,365,889

DATED : November 22, 1994

INVENTOR(S) : John T. Tang

It is certified that error appears in the above-indentified patent and that said Letters Patent is hereby corrected as shown below:

Col. 1, line 46, "frequency" should be --frequent--.

Col. 3, line 50, "spargets" should be --spargers--.

Col. 4, line 59, "spargets" should be --spargers--.

Col. 5, line 9, "spargets" should be --spargers--.

Col. 5, line 18, "spargets" should be --spargers--.

Signed and Sealed this

Seventh Day of February, 1995

*Attest:*

Bruce Lehman

BRUCE LEHMAN

*Attesting Officer*

*Commissioner of Patents and Trademarks*